US009151048B2

(12) United States Patent
Abugattas

(10) Patent No.: US 9,151,048 B2
(45) Date of Patent: Oct. 6, 2015

(54) PRESTRESSED AND CAMBERED STEEL DECKING FLOOR SYSTEM

(71) Applicant: Farid Abugattas, Boca Raton, FL (US)

(72) Inventor: Farid Abugattas, Boca Raton, FL (US)

( * ) Notice: Subject to any disclaimer, the term of this patent is extended or adjusted under 35 U.S.C. 154(b) by 45 days.

(21) Appl. No.: 13/873,066

(22) Filed: Apr. 29, 2013

(65) Prior Publication Data

US 2014/0318056 A1 Oct. 30, 2014
US 2015/0059268 A9 Mar. 5, 2015

Related U.S. Application Data

(60) Provisional application No. 61/644,617, filed on May 9, 2012.

(51) Int. Cl.
*E04B 5/40* (2006.01)
*E04B 5/48* (2006.01)

(52) U.S. Cl.
CPC .... *E04B 5/40* (2013.01); *E04B 5/48* (2013.01)

(58) Field of Classification Search
CPC ..... E04B 5/40; E04B 5/10; E04B 5/48; E04B 5/326; E04B 7/08; E04B 7/107; E04B 3/30
USPC ..... 52/414, 325, 336, 783.15, 783.17, 52/783.19, 73, 223.6, 220.4, 250, 251, 52/259, 319, 537
See application file for complete search history.

(56) References Cited

U.S. PATENT DOCUMENTS 1,867,433 A * 7/1932 Young ..... 52/506.1
1,971,658 A * 8/1934 Ridley ..... 52/348
1,986,122 A * 1/1935 Sargent ..... 174/483
2,039,398 A * 5/1936 Dye ..... 52/847
2,041,965 A * 5/1936 Sargent ..... 52/220.4
2,125,366 A * 8/1938 Young et al. ..... 52/220.4
2,228,650 A * 1/1941 Young et al. ..... 52/407.1
2,445,197 A * 7/1948 Wiesmann ..... 52/220.4
2,672,749 A * 3/1954 Wiesmann ..... 52/220.4
2,992,711 A * 7/1961 Mitchell et al. ..... 52/783.19
3,074,208 A * 1/1963 Seidel ..... 52/220.4
3,102,610 A * 9/1963 Shelby, Jr. ..... 52/783.15
3,251,167 A * 5/1966 Curran ..... 52/327
3,300,839 A * 1/1967 Lichti ..... 29/897.35
3,302,361 A * 2/1967 Oudheusden, Jr. ..... 52/783.19
3,394,514 A * 7/1968 Lindner ..... 52/332
3,397,497 A * 8/1968 Shea et al. ..... 52/334
3,534,463 A * 10/1970 Molin et al. ..... 228/185
3,712,010 A * 1/1973 Porter et al. ..... 52/223.6
4,177,613 A * 12/1979 Czeiner ..... 52/86
4,186,535 A * 2/1980 Morton ..... 52/250
4,285,173 A * 8/1981 Grearson et al. ..... 52/73
4,424,652 A * 1/1984 Turner ..... 52/204.2
4,706,319 A * 11/1987 Sivachenko et al. ..... 14/73

(Continued)

OTHER PUBLICATIONS

Product Catalog: Vulcraft Cellular Deck With Composite Stud Tables.

*Primary Examiner* — Robert Canfield
*Assistant Examiner* — Babajide Demuren

(57) ABSTRACT

A prefabricated composite floor system composed of a prestressed, pre-cambered assembly of a top corrugated composite steel deck (1), a mid corrugated steel deck (2) and optionally (for additional strength) a flat bottom steel sheet (3), all fastened with self drilling screws. The concrete topping acts under compression, the steel module under tension and the longitudinal shear between them is transferred via the self drilling screws.

1 Claim, 2 Drawing Sheets

(56) References Cited

Figure 1:
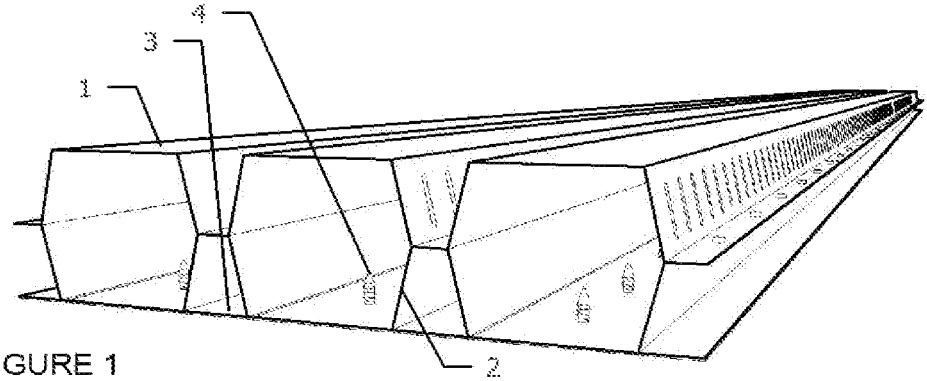

U.S. PATENT DOCUMENTS 4,745,718 A * 5/1988 O'Sullivan et al. ..... 52/223.12
4,809,474 A 3/1989 Eckberg, Jr.
6,848,233 B1 * 2/2005 Haszler et al. ..... 52/783.17
8,317,258 B2 * 11/2012 Honda et al. ..... 296/205
2001/0018816 A1 * 9/2001 Hoepker et al. ..... 52/783.17
2009/0188187 A1 * 7/2009 Studebaker et al. ..... 52/259
2010/0186345 A1 * 7/2010 Hughes, Jr. ..... 52/783.17

* cited by examiner

PRESTRESSED AND CAMBERED STEEL DECKING FLOOR SYSTEM

CROSS-REFERENCE TO RELATED APPLICATIONS

This application claims the benefit of provisional patent application Ser. No. 61/644,617 filed 2012 May 9 by the present inventor.

BACKGROUND

1. Prior Art

The following is a tabulation of some prior art that presently appears relevant:

| U.S. Patents | | |
|---|---|---|
| Patent Number | Issue Date | Inventors |
| 3,397,497 | Aug. 20, 1968 | Edward Fletcher |
| 4,809,474 | Mar. 7, 1989 | Carl E. Ekberg, Jr |

2. Nonpatent Literature Documents

Product Catalog: Vulcraft Cellular Deck With Composite Stud Tables.

Prior art references describe the use of cellular steel decking as a self-supporting and composite pre-fabricated floor system. U.S. Pat. No. 4,809,474 is referenced since it associates the concepts of pre-stressing and steel decking. It differs from this patent application in that in this patent application, the steel decking itself is prestressed without the presence of any concrete. U.S. Pat. No. 3,397,497 shows a similar looking concept in its figure #6, but no mention of cambering or prestressing is made in their patent. Similarly, Vulcraft carries a line of cellular steel decks which are not prestressed or cambered. They mainly work in a multiple span condition. The difference with this patent application is that given the custom fabrication approach to every project, the decking assemblies are designed as simply supported spans and a custom camber is designed for each different span and load condition. The following are the current disadvantages that said systems pose:

1. Early top flange compression buckling when loaded with concrete topping and worker live load.
2. High deflections during concrete pour stage.
3. A preference to use the system in a multi-span fashion to diminish the detrimental effects of the previous two points, resulting in the need for intermediate support members.
4. An inability to customize said system for use in a project where a specific camber and prestress in the system would substantially improve system deflection and resistance performance.

The following are the main performance categories improved by the subject system when compared with conventional cellular composite decking (no prestress or cambering). Two loading stages are discussed. During the construction stage, the loads are those of the self weight of the deck, the concrete topping and the live load of the workers. Resistance is provided solely by the steel module. During the composite stage, the hardened concrete topping acts in compression and the middle and bottom deckings act in tension under the full design load.

1. Gravity load carrying capacity—Higher during the final stage and significantly higher during the construction stage due to the pre-tension in the top decking (1) and pre-compression in the middle decking (2) having to be overcome before a zero stress condition is achieved.

2. Instantaneous deflection performance—Higher, due to cambering having to be overcome first.
3. Long term deflection—Improved, due to the fact that only the superimposed loads will produce sustained compression in the composite topping.
4. Span versus total floor thickness ratio—Improved due to the prestress and camber during construction and final stage.
5. Cost per square foot—Improved, longer spans allow the omission of intermediate support members such as walls, columns and joists which require more end connections and footings.
6. Self-supporting (not requiring any formwork) during construction—Improved due to the camber and prestress enabling longer spans.
7. Initial investment cost to become a fabricator of the system—Reduced, due to the system being composed with standardized and commercially available components such as the top, middle, bottom deckings and self drilling screws.

SUMMARY

In accordance with one embodiment, a pre-fabricated floor system module comprises a pre-compressed top corrugated steel decking, a pre-tensed middle corrugated steel decking and a bottom flat steel sheet, all of which are assembled in a cambered position by multiple rows of self drilling screws.

Advantages

In addition to the previously discussed, several advantages are as follows:

1. With a very minimal initial investment, enable any individual to become a fabricator of the system for his own construction or for others. This is due to the fact that unlike other prefabricated systems, there is no need for bridge cranes, precasting machines, tendon prestressing equipment, concrete mixing equipment or heavy cranes.
2. A fabricator would be able to increase his production capabilities simply by hiring additional workers and buying additional automatic self drilling screw drills (low cost). In comparison to having to purchase and maintain additional equipment mentioned in the previous point.
3. Transportation weight is light in comparison to any precast concrete system.
4. Other systems are unable to completely lose their camber and become flat with the sole weight of the concrete topping. The subject floor system does not require any additional topping thickness in order to provide a minimum thickness at the central section of the span. This implies the camber in the steel module is designed to be completely flattened by the sole weight of the concrete topping alone. This practice reduces unnecessary dead weight and maximizes ceiling height.
5. The system is backwards compatible with the traditional single sheet corrugated steel decking system. This is useful for short span conditions where the additional strength of the subject floor system is not necessary. This can significantly reduce the average cost per square foot of a project.

DRAWINGS

Figures

FIG. 1—Perspective view of the embodiment showing the top (1) and middle (2) corrugated decks (basic parts of the assembly) in addition to the bottom flat sheet (3) which is used when longer spans are required.

Figure 2:
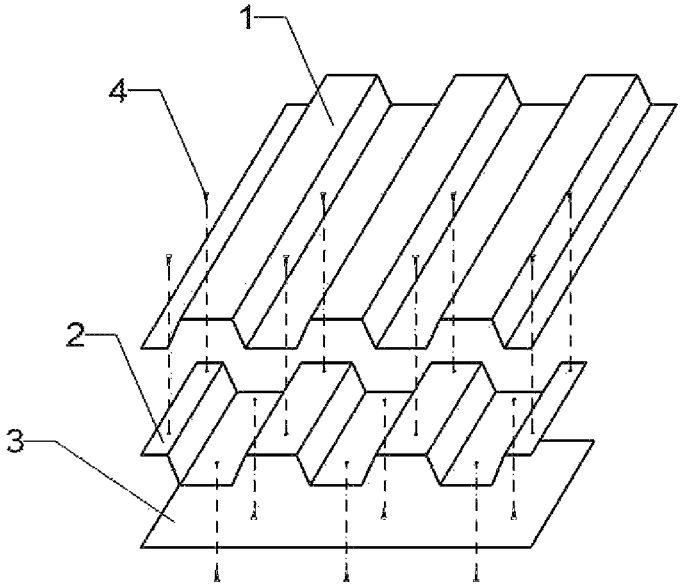

FIG. 2—Assembly drawing showing fastener (4) connection points.

Figure 3:
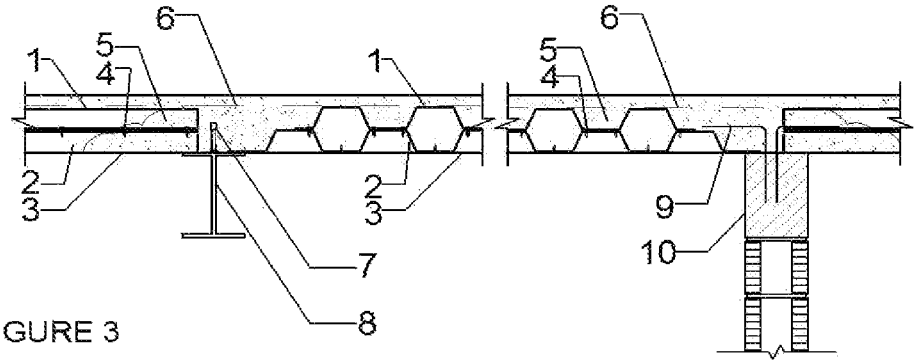

FIG. 3—Shows a typical construction detail of the floor system in use in conjunction with a supporting steel beam (8) and a supporting concrete beam (10).

Figure 4:
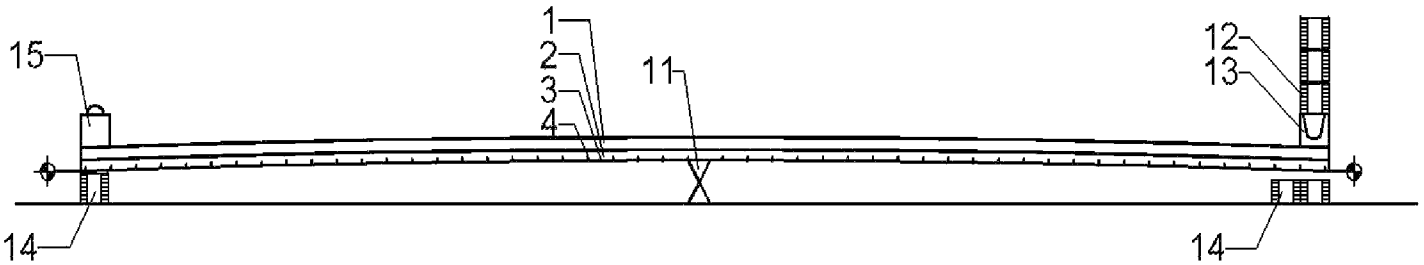

FIG. 4—Shows one method of system fabrication, where a production station is setup by using cinder block (14) to elevate the steel decking being cambered by the cambering block (11) as the end counter weights (15) and (12 and 13) bend the ends of the un-assembled top (1) and middle (2) deckings.

REFERENCE NUMERALS

1. Pre-compressed, top corrugated steel decking.
2. Pre-tensed, middle corrugated steel decking.
3. Bottom flat plain steel decking.
4. Self drilling steel screws or spot welds.
5. Concrete composite topping.
6. Wire welded mesh shrinkage and compression reinforcement or fibermesh additive.
7. Headed studs or other shear collector element (illustrative only).
8. Steel beam or other support member (illustrative only).
9. Diaphragm tie or other shear collector element (illustrative only).
10. Concrete beam or other support member (illustrative only).
11. Cambering block (made of wood or any other material), used to elevate the center portion of the floor as the end weights (15) and station (12 and 13) hold the ends of the system down.
12. Cinder block or other counter weight.
13. Lintel to span across the steel decking which is inserted underneath.
14. Block to elevate the steel decks.
15. Counter weight.

DETAILED DESCRIPTION

One Embodiment (FIGS. 1, 2, 3 and 4)

1. Steel Deckings a) The top (1) and middle (2) corrugated steel deckings are typically 3" composite commercially available deckings that must have their gauge thickness specified by an engineering calculation accounting for all considerations governing light gauge steel design.

b) The bottom flat plain steel decking (3) is a conventional flat steel sheet designed for tensile over its gross area and rupture on the net area adjacent to the fasteners.

c) These three deckings are typically galvanized to offer added corrosion protection.

2. Fasteners a) The fasteners are typically #10 self drilling screws installed with an automatic stand up tool adapter to ease the use of a drill by providing a screw magazine and allowing the operator to drill standing up and use his own weight to force the screws into the steel decks.

b) On the top decking (1) The screws (4) have their points facing down and the heads facing up to prevent the risk of a worker in the job site from stepping on the point of the screw.

3. The Screws are Designed For:

a) Shear resistance b) Supplementing the decking corrugations in transferring the longitudinal shear from the concrete topping to the steel decks by dowel action of the frequently spaced screw heads in contact with the concrete topping.

c) Preventing rupture of the steel deckings being connected.

4. Fabrication a) The steel deckings are ordered from the manufacturer to the desired length.

b) One method of assembly is as shown in FIG. 4. The block (14) on one end is 8" tall, the block (14) near pieces (12 and 13) is 6" tall to allow for a 2" gap over it, under the lintel (13). The top (1) and middle (2) steel deckings are introduced under the lintel and counter weight (15) is placed as to bend the deckings down to make contact with block (14). This key step of bending the independent top (1) and middle (2) decks is what produces a pre-tension in the top deck (1) and a pre-compression in the middle deck (2). At the same time, producing the camber in the steel body.

c) The worker then fastens the top (1) deck to the middle deck (2) together as shown in FIG. 2. The screws lock in the camber so that when the assembled decks are removed from the station the camber remains. It must be explained that the screws, as they are drilled into the deckings, make a hole slightly larger than the diameter of their shank. If the newly cambered assembled decks were to be pre-loaded and then this load released, the module will not return to the full magnitude of it's original camber due to the process of engagement of the screw in it's larger hole. It is this very small displacement of each screw within its hole that overall produces a global loss of camber in the module. The initial camber given to the module must therefore include this engagement camber correction in addition to the camber necessary to balance the deflection due to the self weight of the field applied concrete topping. Once the screws are firmly engaged with the base steel sheet, the load versus deflection behavior of the module is elastic and when loaded within it's elastic limit and released, the module will return to it's original cambered position without any additional loss of camber.

d) At this moment, the module is ready to be loaded for transportation to the job site unless it requires additional strength and a flat bottom sheet is to be added to the assembly. This is done by flipping the assembly currently composed by the top (1) and middle (2) corrugated decks in order to position it up-side-down and enabling for the bottom flat sheet (3) installation to be done from the top side. This allows the worker to once again walk along the top of the module with the drilling tool and assemble the bottom flat sheet (3) to the middle sheet (2). For this configuration, the module is once again more to the upright position and is ready to be shipped to the job site.

e) The assembled modules may be pre side lapped to each other to allow the crane to lift more than one module at the same time and expedite installation this way.

f) The assembled modules are then cut to shape to comply with any architectural plan view terminations such as radius edges or reentrant corners.

g) Once on the job site, the crane places each module from the flat bed truck to it's final position over the walls and beams of the main structure, forming the floor area of the current level being built.

h) Although not part of the subject floor system, the main structural engineer for the building may wish to specify diaphragm ties (9) to be embedded in the composite topping (5)

or headed studs (7) for transferring the lateral diaphragm forces to the main structural shear collectors and shear walls.

i) A crack control element in the form of fibermesh concrete or wire welded mesh reinforcement (6) is typically used in the composite topping (5).

j) Concreting:

1. The topping is placed without any need for temporary shoring.

2. The camber becomes flat, leaving an initial zero deflection composite system.

3. As part of the topping is placed, the top (1) steel decking, originally under pre-tension is subjected to compression, reaching an intermediate state of zero stress while carrying part of the topping weight and the self weight of the floor system steel assembly. As the remaining portion of the topping is placed, the top steel decking continues to be compressed and holds the full weight of the fresh concrete topping and the live load of the workers.

4. Similarly, the middle steel decking, originally under pre-compressive forces is subjected to tensile forces as the weight of the topping and workers is applied during concreting.

5. It is the previous two points that make possible one of the main enhancements the subject floor system exhibits during the construction stage over other existing floor systems, substantially improving it's load carrying capacity, deflection performance and span capability by obtaining a head start in its deflection and stress journey.

k) Composite System:

1. Once the concrete has hardened and before any superimposed loads are added, the system has zero deflection and the topping is under zero compressive stress due to the steel body carrying all of it's weight as the hydration process progressed. At this point, with the entire self weight of the system itself present, if the system were never loaded with superimposed loads, it would theoretically never undergo long term stress deflections as mandated by ACI 318 since the concrete topping has no compressive stress to generate long term creep.

2. It is the previously described mechanism that enables the subject floor system to achieve long spans with a shallow thickness during its composite stage, condition under which the usual failure mode would be long term deflection.

3. Once the superimposed loads are added, the composite topping enters in compression and the middle decking, together with the flat bottom decking, if present, further becomes tensed. The tension-compression couple, typical of a composite system is made possible by the self drilling screws that transmit the longitudinal shear forces from the concrete to the steel deckings.

Extensibility

1. Although the description above contains many specificities, these should not be construed as limiting the scope of the embodiments but as merely providing illustration of one of several possible embodiments.

2. For example:

a) The self drilling screws may be substituted by other dowel like fasteners or welds that adequately connect the steel deckings together.

b) The system may be augmented by using additional or deeper corrugated steel sheets, with different profile shapes that increase or reduce the total thickness of the steel module in order to more efficiently achieve longer or smaller spans.

c) The method of assembly, cambering and pre-stressing may be modified or optimized.

d) The system may be used as a roof, either flat or sloped.

3. Thus the scope of the embodiments should be determined by the appended claims and their legal equivalents, rather than by the examples given.

The invention claimed is:

1. A structural floor or roof system comprising, at least two corrugated steel decks, all of which are in contact with each other;

at least one of said at least two corrugated steel decks is cambered and prestressed in the longitudinal direction by a temporary external bending force, after which said decks are fastened together by connecting fasteners, effectively locking in said camber and prestress and defining a top surface and a bottom surface;

wherein concrete topping is deposited on the top surface such that said camber is of a height substantially equal to a deflection caused by the applied concrete topping resulting in a substantially flat composite profile.

* * * * *